United States Patent [19]

Honeycutt, III et al.

[11] Patent Number: 4,934,443

[45] Date of Patent: Jun. 19, 1990

[54] METHOD OF AND APPARATUS FOR DIRECT CASTING OF METAL STRIP

[75] Inventors: LeRoy Honeycutt, III; James C. Key; Herbert Moody, III, all of Salisbury, N.C.

[73] Assignee: Reynolds Metals Company, Richmond, Va.

[21] Appl. No.: 336,028

[22] Filed: Apr. 11, 1989

Related U.S. Application Data

[63] Continuation-in-part of Ser. No. 263,074, Oct. 27, 1988, abandoned, which is a continuation-in-part of Ser. No. 155,710, Feb. 16, 1988, abandoned, which is a continuation-in-part of Ser. No. 885,718, Jul. 15, 1986, abandoned.

[51] Int. Cl.[5] ..... B22D 11/06

[52] U.S. Cl. ..... 164/479; 164/463; 164/158

[58] Field of Search ..... 164/463, 423, 479, 429, 164/158

[56] References Cited

U.S. PATENT DOCUMENTS 4,588,015 5/1986 Liebermann ..... 164/463

*Primary Examiner*—Kuang Y. Lin

*Attorney, Agent, or Firm*—Lowe, Price, LeBlanc, Becker & Shur

[57] ABSTRACT

A method of direct casting molten metal into strip by providing a melt of the metal to be cast, providing a continuously driven metal chill surface, flowing a layer of the melt onto the moving chill surface and extracting heat from the layer of melt to solidify and temporarily bond the layer of melt to the chill surface and to shrink the solidified layer and cause it to be released from the chill surface, withdrawing the released solidified layer as a continuous metal strip, establishing a natural oxide layer on said chill surface to provide an interface between said layer of melt and said chill surface, and maintaining said natural oxide in a smooth layer of substantially uniform thickness.

18 Claims, 2 Drawing Sheets

METHOD OF AND APPARATUS FOR DIRECT CASTING OF METAL STRIP

This is a continuation-in-part of copending application Ser. No. 263,074 filed Oct. 27, 1988, now abandoned, which was a continuation-in-part of copending application Ser. No. 155,710, filed Feb. 16, 1988, now abandoned, which was a continuation-in-part of application Ser. No. 885,718, filed Jul. 15, 1986, now abandoned.

BACKGROUND OF THE INVENTION

1. Field of the Invention

This invention relates to continuous casting of metal sheet in strip form (hereinafter sometimes referred to as strip), and more particularly to an improved method of high speed direct casting of thin metal sheet by withdrawing the sheet as a continuous strip from a supply of molten metal on a chilled casting surface.

2. The Prior Art

The desirability of directly casting metal sheet in thin strip form on a continuous basis has long been recognized, but the production of a commercially acceptable product by such process, or operation of such a process for sustained periods at commercially acceptable speeds generally has not been considered possible. Such a process would result in substantial savings in energy, manpower and equipment over the conventional process of rolling the strip from ingots, slabs and plates. As used in this application, the terms "sheet" and "strip" are intended to mean crystalline metal sheet in continuous strip form having a width of at least 12 inches and preferably 20 inches or greater, and having a thickness within the range of about 0.015 to about 0.080 inches and preferably within the range of about 0.020 to about 0.060 inches.

Efforts to develop a commercially acceptable process for direct casting of metal sheet on a continuous basis have included various arrangements for contacting a melt with a moving chilled casting surface (chill) to solidify and withdraw the cast strip. These efforts have included flowing the melt at a substantially constant rate onto a moving chill for solidification and withdrawing the solidified strip from the chill in a continuous process as shown in British Patent No. 6,630; conducting the melt from a tundish through a restricted outlet so as to provide a convex meniscus which is contacted by the moving chill as shown for example in British Patent No. 20,518 and U.S. Pat. No. 3,522,836; causing the melt to overflow at an edge or wall of a container or tundish to contact a moving chill as shown in U.S. Pat. No. 993,904 and Japanese published application 58-41656; flowing the melt into the nip of a pair of spaced counter-rotating chill rolls to withdraw a strip which is rolled and chilled on both surfaces as shown for example in U.S. Pat. No. 4,212,344; partially submerging a driven cylindrical chill into the melt to withdraw a strip (or filaments) as disclosed in U.S. Pat. Nos. 3,540,517 and 3,817,901; and, partially submerging a pair of counter-rotating cylindrical chills in a melt to withdraw a continuous strip chilled and rolled on both sides as shown for example in U.S. Pat. No. 3,823,762.

In all of the known prior art continuous or direct strip casting processes employing a continuously driven chill which contacts and withdraws molten metal from a melt (hereinafter referred to generally as a melt drag process), the metal is solidified by extracting heat through the chill so that a thin skin is solidified immediately upon contact with the chill. This skin grows in thickness as the chill moves progressively through or past the melt until the strip is formed. Accurate control of heat transfer between the metal being solidified and the chill during this strip solidifying process is critical to forming a uniform product in any of the melt drag systems mentioned above.

The thin skin formed upon initial contact of the melt with the chill is firmly adhered to the chill and this intimate, bonded contact results in a maximum heat transfer from the melt to the chill. As the solidifying skin progressively increases in thickness, the heat extraction results in contraction of the solidifying strip until the bond is broken, thereby resulting in a substantial reduction in the rate of heat extraction.

The production of high quality directly cast strip product depends to a large degree upon a controlled heat transfer rate and uniform release of the cast product from the chilled surface. For example, when the heat transfer rate is too high, release can result before the solidifying skin has attained the desired or necessary thickness and remelting or breakage may result. Nonuniform release will result in gauge variations which may be so great as to make subsequent cold rolling operation difficult or impossible. Also, surface cracks may be formed in the top surface of the product, i.e., the product surface not in contact with the chill.

Various attempts have been made to accurately control the heat transfer rate between the melt and the chill in a direct or continuous melt drag strip casting operation. These attempts have included providing a knurled surface on the chill (U.S. Pat. No. 3,345,738) to thereby impart to the bottom surface of the solidifying strip a network or grid of point indentations. This patent teaches that the point indentations provide controlled or uniform release of the solidified strip from the chill to produce a more uniform cooling rate and strip thickness.

Another attempt to control the heat transfer rate and provide a more uniform release of the strip from the chill is disclosed in U.S. Pat. No. 3,540,517. According to this patent, direct contact between the melt and chill is avoided by applying a thin coating of a particulate refractory material to the chill prior to its contact with the melt. The particulate refractory is applied in a water slurry or other fast drying solution on a continuous basis as by spraying. The slurry may be applied with or without a binder. The particulate material may be alumina, silicate oxide, magnesia or ground fire clay particles, for example, and is intended to break up the contact area between the solidifying melt and the chill. This technique, however, necessarily results in a substantial number of the refractory particles adhering to and/or becoming embedded in the surface of the product and a uniform casting thickness or particle distribution cannot always be achieved.

Other prior art practices for controlling the rate of heat transfer between a melt and a chill in a continuous strip casting process are discussed in U.S. Pat. No. 4,250,950. As stated in this patent, the "state of the art" methods involve either (1) coating the chill with a thermally insulating or protective layer, or (2) mechanically roughening the chill surface. The thermally insulating coating technique is described as involving either spraying or plasma spraying and it is stated that the coating must be deposited after each contact with the melt. Drawbacks of the coating technique are stated to include defects resulting from non-uniform coating and surface contamination of the product as a result of particle pickup.

The mechanically roughened chill surface technique described in U.S. Pat. No. 4,250,950 is stated to enable the regulation of heat transfer by controlling the contact area between the chill and melt. The chill is roughened by shot peening or by grooving. While grooving is described in U.S. Pat. No. 3,345,738, supra, as ineffective for the process, it is noted that that early patent employed groove spacings of 0.25 inches (6.35 mm) whereas the current practices described in U.S. Pat. No. 4,250,950 considers groove spacings greater than 0.5 mm (0.02 inches) as a coarse grooving. The function of the grooving employed in the prior art described in U.S. Pat. No. 4,250,950 and the cross grooving of that patent is to avoid trapping evolving gases and/or air between the surface of a solidifying melt and the chill, which gases tend to produce uneven release and non-uniform heat transfer when trapped between a forming strip and the chill. This function of a roughened or grooved chill surface is believed to be generally understood and accepted in the art.

It is also known to continuously abraid a chill to continuously present a clean, matte metal surface into contact with the melt. For example, rotary wire brushes have been employed to contact and clean a cylindrical chill surface following release of the cast strip and before the surface again contacts the melt, as described, for example, by Huang and Fiedler in *Metallurgical Transactions* A, Vol. 12A, pgs. 1107–1112 June 1981. While this technique can enhance the quality of product produced either on a smooth or roughened, e.g., grooved, chill by providing a more uniform heat transfer, the process has not been entirely satisfactory. Further, the rapid abrasion of the chill, whether formed from high strength steel or a softer material such as copper or aluminum, by a continuously driven stainless steel brush or other aggressive abrading means requires frequent shutdowns for chill roll surface refinishing or roll changing.

As is known, even though a completely clean matte chill surface is provided at the beginning of a direct strip casting process, the high temperature of the melt contacting the chill results in rapid oxidation of the chill surface. This is particularly true where, as is usual, the chill moves in the open atmosphere for a substantial distance after release of the cast strip and before the chill surface is again presented in contact with the melt. In addition to oxides of the base metal of the chill, the natural oxide layer or coating which builds up on the chill may include at least a small percentage of oxides of the melt.

It has long been recognized that an accumulation or buildup of oxides and other material on the chill surface reduces the heat transfer rate between the melt and chill, and it is for this reason that some processes have provided an abrading means to continuously remove such material.

The natural oxide coating which inherently builds up on the chill surface during strip casting is not a homogenous, even coating and consequently tends to produce an uneven heat transfer rate depending upon the thickness and condition of the coating. It has been learned, also, that this coating is not a coherent, dense coating throughout but rather it builds as a dense, compact inner layer and a less dense outer portion comprising loose particles which can flake off or adhere to the surface of a strip cast on the chill.

Despite the long recognition that uniform heat transfer between the melt and chill surface is essential in a continuous or direct strip casting operation to avoid surface defects and thickness variations, and despite the substantial effort which has been directed to achieving such uniform heat transfer, the prior art processes are generally incapable of achieving such uniform heat transfer to the extent desirable in a commercial continuous or direct strip casting operaton. Accordingly, it is an object of the present invention to provide an improved method of directly casting metal strip by providing a more uniform heat transfer between a melt of the metal being cast and a chill surface moving in contact with the melt to continuously withdraw the strip Another object is to provide an improved process for controlling the gauge thickness of metal strip produced by direct casting from a melt on a continuous chill moving in contact with the melt to withdraw the cast strip.

Another object is to provide an improved melt drag strip casting process employing a continuous chill surface to solidify and withdraw the strip from a melt of the metal to be cast and in which a thin compact natural oxide interface is established and maintained between the base metal of the chill and the melt to thereby control the rate of transfer of heat between the melt and the chill, the metal oxide interface being a compact, smooth layer of the natural oxide developed in the melt drag process and being firmly adhered to the base metal of the chill surface.

The foregoing and other features and advantages are achieved in accordance with the present invention wherein a melt of the metal to be cast is brought into contact with a continuously moving chill to solidify a strip of uniform thickness on the surface of the chill and the strip removed after solidification is substantially complete. The chill may be an internally cooled cylindrical casting wheel and the process will be described herein with specific reference to a process using such a chill, it being understood that other chill configurations such as a flat belt or so-called caterpillar track chill surface may also be employed.

In accordance with the invention, a melt of the metal to be cast is brought into contact with the chill which is driven at a predetermined rate to solidify and withdraw the strip from the melt at a substantially constant velocity. The invention will be described herein with reference to a process wherein the chill is positioned to effectively form one wall of a container for the melt, it being understood that other arrangements could be employed as suggested above. For example, the chill could be partially submerged into the top surface of the melt, or the chill may be positioned adjacent the edge surface of the melt container and the molten metal caused to overflow to contact the chill. In another possible arrangement, a conduit or nozzle could be employed to conduct the melt from a supply into contact with the moving surface of the chill.

Heat transfer from the melt to the chill is achieved at a uniform, desired rate while maintaining an oxide coating on the chill surface This is accomplished by establishing a coherent, dense, smooth natural oxide interface between the melt and the base metal of the chill, with the oxide interface consisting primarily of an oxide of the base metal of the chill surface and oxides of the primary metal and alloy metals of the melt. The uniform interface is achieved by continuously wiping or brushing the chill surface following release of a cast strip and prior to the surface re-entering the melt, whereby loose oxide particles and any adhering particles of the melt are continuously removed from the chill. The brushing or wiping action acts to lightly polish the oxide coating, producing a smooth surface on the oxide interface, with the oxide being of substantially uniform density over the entire chill surface. Further, this light polishing action can maintain the oxide thickness within a range which will produce a substantially uniform heat transfer rate. It is critical, however, that the polishing action not be sufficiently abrasive to remove the dense adhering oxide interface and thereby expose and abrade or damage the base metal of the chill surface. By controlling the polishing action to increase or decrease the oxide coating thickness and to maintain the desired thickness, the heat transfer rate can be controlled and thereby an effective strip gauge control is achieved.

BRIEF DESCRIPTION OF THE DRAWINGS

The foregoing and other features and advantages of the invention will be apparent from the detailed description contained hereinbelow, taken in conjunction with the drawings, in which.

DESCRIPTION OF THE PREFERRED EMBODIMENT

Figure 1:
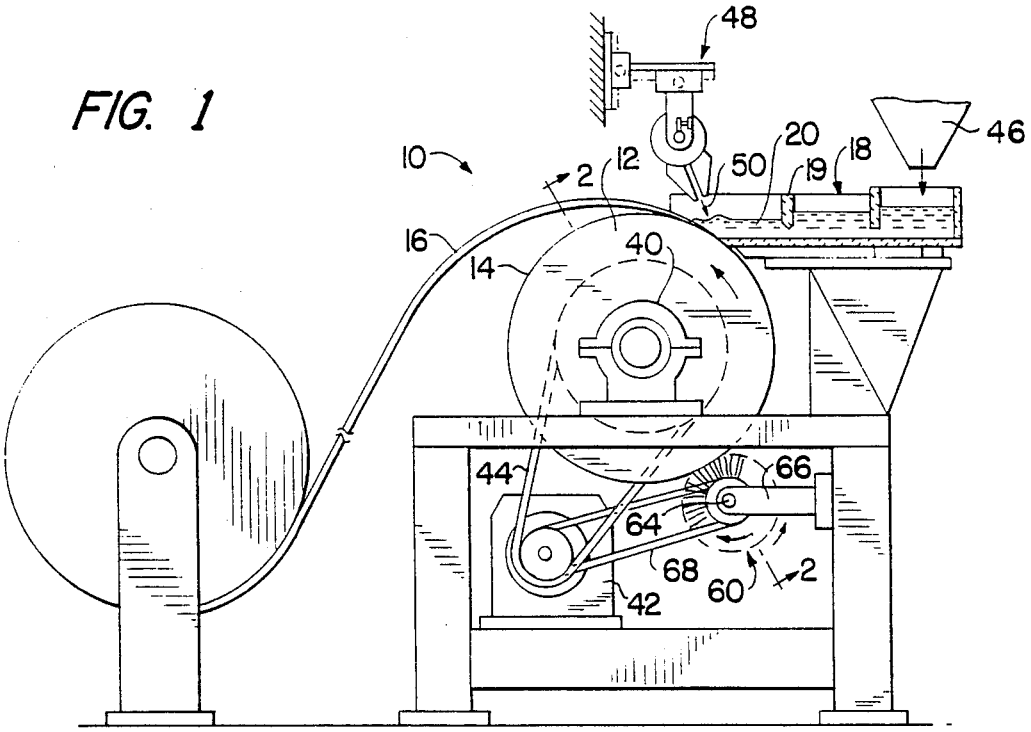
FIG. 1 is a schematic elevation view, partially in section, of an apparatus for direct strip casting of metal by a melt drag process embodying the present invention.

Referring now to the drawings in detail, a melt drag strip casting apparatus suitable for use in the practice of the present invention is illustrated schematically in FIG. 1 and is designated generally by the reference numeral 10. The apparatus includes a chill 12 in the form of a casting wheel or drum having a cooled cylindrical outer surface 14 upon which the metallic strip 16 is cast. A tundish assembly 18 is supported in close proximity to the casting wheel 12 in position to supply molten metal 20 contained therein at a uniform depth into contact with the chill surface 14

Figure 2:
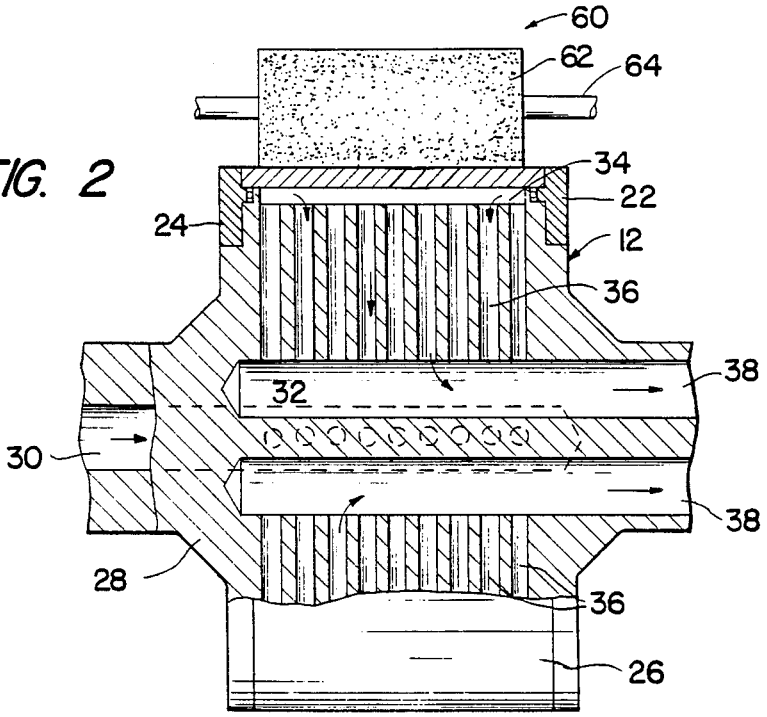
FIG. 2 is a sectional view taken on the line 2—2 of FIG. 1.
Figure 3:
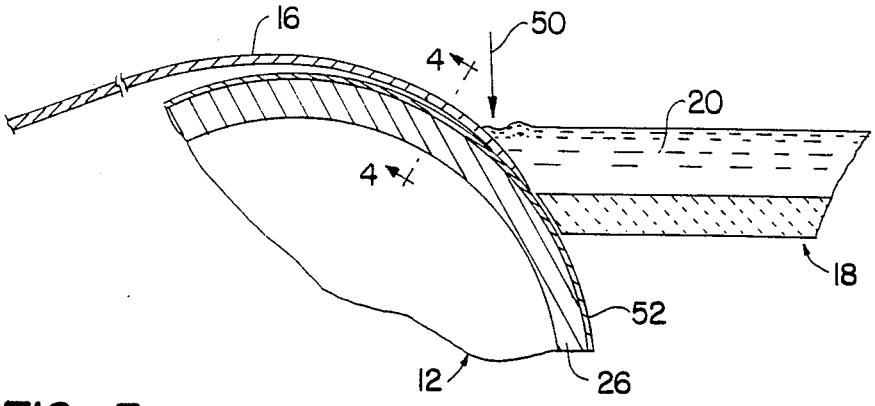
FIG. 3 is an enlarged fragmentary view, in section, of a portion of the apparatus shown in FIG. 1.
Figure 4:
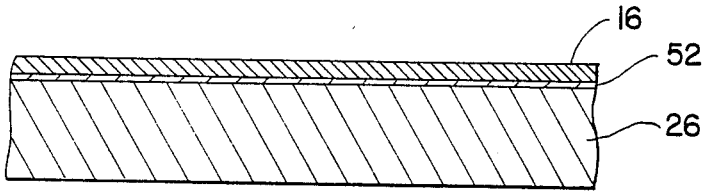
FIG. 4 is a sectional view taken on line 4—4 of FIG. 3.

The casting wheel 12 is internally cooled with circulating water or other cooling fluid to rapidly extract heat through surface 14 to thereby quench and solidify liquid metal from the melt 20 which contacts the peripheral casting surface 14 as it rotates upwardly through the melt in tundish 18. Internally cooled casting wheels are known for example from U.S. Pat. No. 2,348,178, and as schematically illustrated in FIG. 2 may comprise a hollow drum made from a pair of end flanges 22, 24 and an outer peripheral rim 26, the outer surface of which rim defines the chill or casting surface 14. A central hub 28 supported within the hollow drum has axially and radially extending, connecting inlet passages 30, 32, respectively communicating with the annular space 34 between hub 28 and the outer rim 26, and radially and axially extending connecting passages 36, 38 communicating with the annular space 34 provide an outlet for the cooling fluid.

The cylindrical rim 26 is formed from any suitable metal having the desired thermal conductivity and wear characteristics, copper, steel and aluminum, and alloys of these metals, being examples of materials which have been successfully employed in the high speed casting of strip metal in apparatus of the type illustrated in FIG. 1. The chill surface 14 may be substantially smooth, but preferably has a pattern of closely spaced shallow grooves 39 formed therein as more fully described hereinbelow with respect to FIG. 5 and as illustrated for example in U.S. Patent Nos. 4,250,950 and 3,345,738 and in French Patent No. 1,364,717.

Suitable means such as bearings 40 support the casting wheel 12 for rotation about a fixed horizontal axis on a rigid support frame adjacent tundish 18, and suitable drive means such as a variable speed motor and reduction gear mechanism 42 and drive chain 44 illustrated schematically in FIG. 1 drive the chill about its fixed axis.

In the illustrated embodiment, tundish 18 has an open end positioned adjacent the chill, with transverse walls or dams being provided for controlling the flow of molten metal through the tundish to maintain a substantially uniform depth of the melt in contact with the rotating chill surface 14. Suitable means such as a ceramic trough or runner indicated generally at 46 provides molten metal to the tundish preferably at a substantially constant rate. Also, an air knife assembly 48 may be provided to direct a substantially continuous, uniform thin jet of gas indicated by the arrow 50 onto the surface of the melt and strip adjacent the point of emergence of the strip 16 from the melt. The jet 50 assists in control of the shape of the top surface of the strip 16 and prevents dross, oxides, slag or the like floating on the top of the melt 20 from coming into contact with and adhering to the top surface of the emerging strip in the manner disclosed and described in detail in U.S. Patent No. 4,751,957, assigned to the assignee of this application. Alternatively, an uncooled top roll (not shown) may be employed to contact the top liquid surface portion only of the emerging strip moving with the chill surface 14.

In the casting of certain metals such as aluminum which have a high affinity for oxygen, it may be desirable to provide an inert atmosphere above the free surface of the melt 20 in tundish 18. This may be accomplished by providing a cover or shield for the tundish and injecting an inert atmosphere under the shield to thereby purge air from the tundish enclosure. When an air knife 48 is employed, the inert atmosphere may be supplied by the gas jet 50 discharged onto the emerging strip surface.

Although a large volume of cooling fluid is normally circulated through the chill to extract heat from peripheral rim 26, the outer surface 14 is heated to a relatively high temperature when in contact with the melt 20 and this surface tends to oxidize rapidly in the presence of oxygen in the open atmosphere. In the past, this oxide formed on surface 14 has been removed by an abrasion or wire brushing process to prevent buildup on the external surface of the chill at least in the area contacted by the melt during the strip casting operation. For example, when casting 3000 series aluminum alloy on a steel chill surface, the steel surface will quickly turn a dark blue as it commences to oxidize following contact with the molten metal while casting 1000 series alloy will produce a more gray-black oxide. Variations in appearance of the oxide coating will become visible to the naked eye as thickness of the natural oxide increases and as oxides and particles of the metal being cast are picked up in the coating.

It has been found that the undisturbed natural oxide coating which develops on the chill surface in a melt drag direct strip casting process will eventually become substantially stable in overall thickness. For example, a steel chill surface employed in the direct strip casting of aluminum will develop a natural oxide coating which initially will consist primarily of iron oxide. As this oxide coating grows in thickness, a dense firmly adhering layer develops adjacent the steel chill surface, with the remainder of the coating thickness being less dense and containing increased portions of oxides of the aluminum and its alloy metals and containing more scale and flakes. As a result, an oxide coating developed in this manner is not a homogenous coating and does not have uniform surface characteristics, at least in part because of the non-uniform flaking and peeling of the outer portion of the coating during casting. Further, flakes or particles of the less dense portion of the coating tend to adhere to or become embedded in the surface of the cast strip, thereby producing non-uniform surface characteristics on the strip.

The thickness of a natural, undisturbed oxide coating which develops in a direct strip casting process will, of course, vary both with the metal being cast and with the base metal of the chill. Also, the maximum thickness of the compact interface which can be maintained will vary in a like manner. The casting of steel strip, for example, will result in a more rapid oxidation of the chill surface than casting aluminum which has a much lower melting temperature. The gradual buildup in thickness of the natural oxide coating which develops on a chill surface during strip casting will result in a gradual decrease in gauge thickness of the strip being cast until the coating stabilizes in thickness. However, variations in the surface characteristics and thickness of such an undisturbed oxide coating over the chill surface, and the consequent variation in thermal conductivity of the coating, will be evidenced by variations in strip gauge and surface characteristics.

It has been discovered that, by removing the outer portion only of the natural oxide coating developed on the chill surface while leaving intact the more dense oxide layer adjacent the chill surface, a uniform natural oxide interface can be established and maintained between the chill and the strip being cast. As a result, a substantially more uniform heat transfer rate can be provided over the casting surface and consequently more uniform strip surface characteristics achieved throughout the melt drag casting process. This interface may be established by a continuous wiping or brushing action to lightly polish surface 14 at a position in its path between the release point of the strip and the point at which the chill surface is again contacted by the melt 20 in tundish 18.

In removing the outer, less dense portion of the natural oxide coating from the chill surface, it is critical to the invention that the remaining dense oxide left on the entire area of the chill surface which contacts the molten metal be left in a uniform, substantially smooth or polished condition substantially free of loose particles which might be picked up on the surface of the cast strip or which might interfere with the uniform heat transfer and release of the strip from the casting surface. This smooth polished oxide interface acts as a release agent, assuring uniform release of the strip from the chill, and this in turn produces a more uniform gauge thickness for the strip.

Various devices and materials have been tested for lightly polishing the chill to maintain the desired natural oxide interface. The driven cylindrical brush device illustrated in FIGS. 1 and 2 has proven highly effective in removing the loose outer layer of oxide particles and in producing a smooth clean surface on the dense natural oxide interface remaining on the chill surface. The rotation of the cylindrical brush produces a natural cleaning action preventing the buildup of oxide particles on the polishing medium, i.e., the brush bristles. Further, by adjusting the position of the rotary brush 60 to produce an increased or decreased contact, or pressure, on the rotating chill surface while maintaining the distance from the brush axis to the chill surface uniform across the width of the strip, the thickness of the oxide interface can be increased or decreased, as desired, while being maintained uniform to thereby provide an effective gauge control for the strip. The speed of operation of brush 60 will also effect its efficiency in removing oxide and preferably a variable speed brush drive is employed to thereby provide an easy, readily adjustable control of oxide thickness during operation. The variable speed drive can be used in conjunction with power means for adjusting the brush bearing position to provide a wide range of control for prolonged or continuous operations.

Although various brush materials have been tried experimentally, the most effective polishing medium now known is a brush employing relatively soft synthetic fibers impregnated with very fine abrasive particles. Specifically, a commercially available cylindrical brush having nylon bristles impregnated with 30%, by weight, of 500-grit silicon carbide particles has been found to be highly effective in establishing and controlling the desired smooth oxide coating on a steel chill surface during casting of aluminum. A similar brush containing 320-grit particles has also been used and may be desirable for longer continuous casting runs. The rotary brush bristles 62 are trimmed so that their free ends accurately define a cylindrical brushing outer surface, and the brush position may be adjusted so that the end portions only of the bristles lightly touch, or "kiss" the chill surface during operation. Preferably, however, contact is sufficient to cause slight bending at the end of the bristles, and in this respect, it is noted that contact between the brush 60 and chill 12 is exaggerated in FIG. 1 for illustration purposes only.

Figure 5:
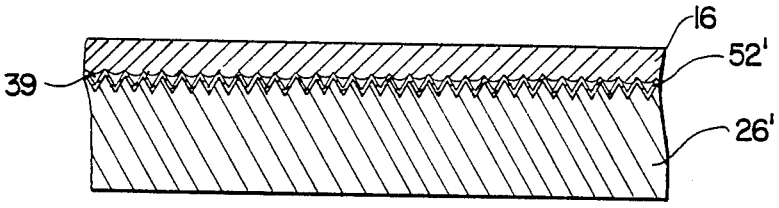
FIG. 5 is a view similar to FIG. 4 and showing an alternate construction of a portion of the apparatus employed in the practice of the invention.

When a casting wheel 12 is employed which has a grooved chill surface 14 of the type illustrated in FIG. 5, the groove spacing measured axially along the surface of the cylindrical chill may be such as to provide from about ten to about forty grooves per centimeter and the grooves may have a depth of from about 0.025 to about 0.60 millimeters. When the nylon-silicon carbide brush described above is employed with such a grooved chill surface, contact between the ends of the brush bristles and the chill is maintained so as to produce a polished oxide surface on the outer or land portion of the grooves but the bristles do not penetrate into the root of the respective grooves with sufficient pressure to remove all the loose oxide particles from this area. In use, such a chill surface will have the visual appearance of alternate light and dark lines, with the light lines being smooth polished oxide areas on the lands and the darker areas being in the root regions of the grooves. As is apparent from FIG. 5, however, when the melt 20 comes into contact with the chill surface, surface tension normally prevents the liquid metal from penetrating into the root area of the grooves. Since the strip 16 does not contact the unpolished oxide coating near the roots of the grooves, it is not necessary to polish these areas. When a smooth chill surface is employed, however, it is important that the smooth lightly polished natural oxide interface extend over the entire area of the chill surface which will be contacted by the melt. Also, when a grooved chill surface is employed, it is important that the oxide not be permitted to build up and fill the grooves, and the use of the silicon carbide impregnated nylon bristle brush described above and mounted for rotation about an axis parallel to the chill axis to control the oxide coating in accordance with the present invention has been found to be very effective in keeping the grooves effectively open while maintaining the desired oxide interface on the land surfaces.

In operation of an apparatus of the type illustrated in the drawings to cast aluminum strip on a carbon steel chill surface, the position of the polishing brush relative to the chill surface can be adjusted to remove more or less of the natural oxide coating. It has been found that a natural oxide interface will immediately start to build on the steel chill surface and will continue to grow in thickness until gauge control and strip surface qualities quickly commence to deteriorate if the oxide thickness and surface condition are not controlled in accordance with this invention. The oxide interface thickness can be controlled to prevent excessive buildup, however, by accurately positioning and driving the polishing brush so that the loose outer oxide particles are removed. Since the oxide interface thickness directly affects the heat transfer rate between the molten metal and the chill, and thereby directly affects the thickness of the strip being formed, control of the thickness of the oxide interface produces an effective strip shape and gauge control.

It is critical to the present invention that a substantially uniform thickness of oxide coating be maintained across the full width of the strip being cast. However, while extensive theoretical and experimental research has gone into the design and construction of internally cooled chill wheels of the type employed in this invention, an absolutely uniform chill temperature cannot always be maintained along the axial dimension of the chill surface, or across the width of the cast strip. Accordingly, in order to produce the desired cross sectional shape for the strip, it may sometimes be necessary or desirable to intentionally adjust one end of the brush to produce slightly more or less pressure, with a consequent change in oxide thickness, on the chill surface at one side of the strip. Such intentionally produced misalignment of the chill and brush axes and the consequent non-uniformity of oxide casting will be very slight, however, and it should be understood that the term "substantially uniform thickness" as used herein is intended to embrace such deliberately produced non-uniformity.

A smooth polished oxide interface acts as a release agent, resulting in a uniform release of the formed strip from the chill surface. This greatly improves the strip quality both from the standpoint of top surface characteristics and from the standpoint of eliminating or greatly reducing variations in strip thickness. Further, extensive testing has shown that this process substantially eliminates the problem of longitudinal cracking of the top strip surface of direct cast aluminum strip.

It is also essential to any commercial strip casting operation that the cast strip be of substantially uniform thickness throughout a production run which may involve casting from one to a substantial number of coils of strip. The present invention makes this uniform gauge possible by making it practical to maintain a substantially uniform oxide coating on the chill surface for sustained periods. The use of a simple, commercially available variable speed drive for the rotary brush provides easy and accurate control of the oxide thickness to compensate for brush wear or other changing conditions to maintain the desired substantially uniform oxide thickness throughout a run.

While a silicon carbide impregnated nylon bristle rotary brush has proven to be highly effective and reliable in establishing and controlling the natural oxide interface on the chill surface in a melt drag strip casting operation, other materials and techniques may be employed to maintain this interface. For example, other synthetic materials may be employed for the bristles in a rotary brush and the synthetic bristles may be impregnated with other polishing agents. Also, both natural bristles and synthetic bristles which are not impregnated or coated with hard polishing agents may be employed and may be preferred when employed with a chill surface formed from a relatively soft material such as copper or aluminum, or alloys of these materials. As indicated above, however, it is important that the polishing material used be capable of removing the loose particles of natural oxide formed on the chill surface during the direct casting process while leaving the packed, more dense natural interface. Further, this interface should present a substantially smooth surface for contact with the molten metal to be cast.

Examples of materials and techniques that have been successfully tested to establish and maintain the natural oxide interface on the chill surface in accordance with the invention have included both stationary and rotary brushes, brushes having horse hair bristles and bristles of other natural materials, and stationary felt pads. While these various materials and devices produce readily visible improvements in the cast strip over the prior art practices described above, reliable control of the process while employing such other devices and materials for longer or sustained runs have proven more difficult in operation than with the impregnated synthetic resin bristle brushes.

An internally cooled casting wheel of the type illustrated in the drawings was used to directly cast aluminum strip from numerous heats of molten aluminum alloy. This casting wheel had an outer peripheral rim 26 made of alloy 1020 carbon steel and the outer casting surface had 44 generally circumferentially extending grooves per inch, a diameter of 27.635 inches, and a width of 42 inches. This used casting wheel was removed from the casting apparatus and sample sections were cut from the carbon steel rim for examination. The samples were removed from areas transversely spanning the casting surface from the edge to approximately the center of the casting surface. The actual casting track on the surface of the casting wheel was defined by a visibly oxidized surface. The samples were degreased and nickel plated to preserve the oxidized surface during metallagraphic preparation.

Metallagraphic examinations of the samples showed that, at the edge of the rim outside the casting track where no oxide was apparent to the unaided eye, no coherent or continuous oxide film could be detected either on the lands or in the grooves at magnifications up to 2,000X. Within the visibly oxidized casting track region the oxide on the lands, i.e., the surface portion between the grooves which contacts the molten metal, was a multiphase oxide whereas the oxide present on the sidewalls of the grooves appeared to be single phase consisting essentially of iron oxide. The metallography of the oxide on the lands across the casting band appeared to be substantially identical although color differences from bluish black to brownish gray were observed.

Oxide thicknesses actually measured were substantially greater than original calculations indicated would be developed under the casting conditions. Further, localized variations in oxide thickness were observed which were not anticipated, with these variations being principally in the form of relatively thin spots at the base of small crevices in the land surfaces which possibly had minimum contact with the solidifying metal during casting. These minute crevices were found on careful examination although the casting wheel had been prepared to present a highly polished, uniformly smooth casting surface. The thicker oxide coating extended over most of the land surfaces except for the minute crevice areas mentioned. Maximum and minimum thickness measurements were recorded and the average of the maximum oxide thickness measurements was 12,400 angstroms while the average of the minimum oxide thickness measurements in the crevice areas was 1,450 angstroms. Again, it should be understood that the term "substantially uniform thickness" as used herein is intended to embrace an oxide coating having such unavoidable localized thickness variations.

A subsequent test conducted on a single 4 inch section from the casting band of the same casting wheel rim also included a survey of the oxide composition and thickness in the grooves as well as on the lands. The land width for this sample ranged from 0.009 to 0.010 inches. Results of this test confirmed that the oxide contained within the grooves was essentially a single phase coating of iron oxide. Also, this test indicated that the thickness of the multiphase oxide on the land portion of the surface was approximately $\frac{1}{3}$ the thickness and about four times more uniform than the oxide coating in the grooves.

A second casting wheel similar to that described above has been used to make a number of runs to produce directly cast strip aluminum alloy 3105. In one such run, a heated top roll was positioned in contact with the molten metal on the top surface of the strip emerging from the tundish, and a silicon carbide impregnated nylon brush of the type described above and driven for rotation about an axis parallel to the chill axis was employed to lightly polish the chill surface. When the parameters of the process reached equilibrium, i.e., the rate of flow of molten metal from the tundish, the speed of rotation of the casting wheel and speed of rotation of the top roll were stabilized, the system was operated to produce continuously 5,000 pounds of strip 30 inches wide in a period of 18.5 minutes. The strip had a substantially uniform thickness in transverse profile and both the top and bottom surfaces of the strip were found to be of commercial quality.

Samples from the cast strip just described were measured to determine the variations in strip profile, i.e., variations in strip thickness transversely across the strip width, and strip shape, i.e., variations in thickness along the length of the strip. Profile measurements were taken at 2 inch intervals across the strip and showed a deviation of only ±0.002 inches from the mean strip thickness of approximately 0.042 inches. The shape measurements were taken at one foot intervals and also showed a deviation in gauge from the mean of only about 0.002 inches. Casting speed during this run varied from 250 to 205 feet per minute. Approximately one half of the coil of 3105 aluminum strip alloy produced was slit to remove one inch from each side of the strip, then rolled in a cold mill at speeds of up to 500 feet per minute.

While specific reference has been made to the casting of aluminum alloys on a steel casting surface, it should be apparent that the casting of other metals and alloys will produce oxide coatings having different characteristics. Similarly, natural oxides formed on chill surface formed from other metals such as copper or aluminum will require brushing and polishing techniques which are different than those formed on a steel chill. Further, different natural oxide coatings and substrates may require more or less abrasive brushing and polishing materials to maintain the desired uniform oxide interface. Accordingly, while a preferred embodiment of the invention has been disclosed and described in detail, it should be apparent that various modifications may be made and it should be understood that the invention is not limited t the disclosed embodiments but rather includes all modifications thereof which would be apparent to one skilled in the art and which come within the spirit and scope of the invention.

What is claimed is:

1. In a method of direct casting crystalline metal sheet in a continuous strip, including providing a melt of the metal to be cast, providing a continuously driven metal chill surface, flowing a layer of the melt onto the moving metal chill surface and extracting heat from the layer of melt through the chill surface to solidify and temporarily bond the layer of melt to the chill surface and to shrink the solidified layer and cause it to be released from the chill surface, said layer having a width of at least 12 inches, and withdrawing the released solidified layer as a continuous metal strip having a thickness in the range of 0.015 to 0.080 inches, the improvement comprising, establishing a natural oxide interface between said layer of melt and said metal chill surface by permitting a natural oxide layer to develop on the surface of said metal chill surface as a result of exposure to heat from the melt and to the atmosphere, and maintaining said natural oxide interface in a smooth layer completely covering the area of said chill surface contacted by said melt by continuously engaging said natural oxide layer with a cylindrical rotary brush mounted for rotation about an axis spaced equal distant from the casting surface across the width of the strip, and driving said brush to polish the natural oxide interface following release of the metal strip, said polishing being accomplished in a manner to remove only the outer portion of natural oxide layer developed while leaving a smooth, continuous packed layer of natural oxide firmly adhering to the chill surface to provide said smooth natural oxide interface whereby abrasion of the metal chill surface is avoided, said layer of natural oxide being of substantially uniform thickness across the width of the chill surface and being maintained at said substantially uniform thickness substantially throughout the casting run.

2. The method defined in claim 1 wherein said driven rotary brush comprises a brush having bristles formed from a synthetic resin material.

3. The method defined in claim 2 wherein said bristles are impregnated with a finely divided abrasive material.

4. The method defined in claim 1 wherein said bristles are silicon carbide impregnated nylon bristles.

5. The method defined in claim 4 further comprising the step of adjusting the position of said rotary brush relative to said chill surface to thereby control the thickness of said natural oxide interface.

6. The method defined in claim 4 further comprising the step of varying the speed of rotation of said rotary brush to thereby control the thickness of said oxide layer.

7. The method defined in claim 1 wherein said rotary brush comprises a brush having natural fiber bristles

8. The method defined in claim 7 wherein said natural fiber bristles comprise horse hair.

9. The method defined in claim 1 wherein said metal chill surface comprises the outer surface of a cylindrical internally cooled metal casting drum driven for rotation about a fixed horizontal axis.

10. The method defined in claim 9 wherein the molten metal being cast is aluminum and wherein said strip has a width of at least about 20 inches and a thickness within the range of 0.020 to 0.060 inches.

11. The method defined in claim 10 wherein said step of contacting and polishing said metal chill surface comprises continuously engaging said natural oxide on said chill surface with a rotary cylindrical brush having synthetic resin bristles impregnated with a finely divided abrasive material, said brush being driven for rotation about horizontal axis parallel to the axis of said casting drum and being effective to remove loose oxide particles from the oxide layer without removing the dense oxide layer whereby abrasion of the metal chill surface is avoided.

12. The method defined in claim 11 further comprising the step of adjusting the position of said rotary brush relative to said chill surface to thereby control the thickness of said natural oxide interface.

13. The method defined in claim 11 wherein said bristles are silicon carbide impregnated nylon bristles.

14. The method defined in claim 11 further comprising the step of varying the speed of rotation of said rotary brush to thereby control the thickness of said oxide layer.

15. The method defined in claim 14 wherein said bristles are silicon carbide impregnated nylon bristles.

16. The method defined in claim 11 wherein said rotary brush comprises a brush having natural fiber bristles.

17. The method defined in claim 16 further comprising the step of adjusting the position of said rotary brush relative to said chill surface to thereby control the thickness of said natural oxide interface.

18. The method defined in claim 17 wherein said natural fiber bristles comprise horse hair.

* * * * *